US008807104B2

(12) United States Patent
Flierl

(10) Patent No.: US 8,807,104 B2
(45) Date of Patent: Aug. 19, 2014

(54) MECHANICALLY CONTROLLABLE VALVE OPERATING MECHANISM, AND MECHANICALLY CONTROLLABLE VALVE OPERATING MECHANISM ARRANGEMENT

(75) Inventor: Rudolf Flierl, Hirschau (DE)

(73) Assignee: Kolbenschmidt Pierburg Innovations GmbH, Neckarsulm (DE)

( * ) Notice: Subject to any disclaimer, the term of this patent is extended or adjusted under 35 U.S.C. 154(b) by 0 days.

(21) Appl. No.: 13/879,807

(22) PCT Filed: Aug. 31, 2011

(86) PCT No.: PCT/EP2011/065044

§ 371 (c)(1),
(2), (4) Date: Apr. 17, 2013

(87) PCT Pub. No.: WO2012/052216

PCT Pub. Date: Apr. 26, 2012

(65) Prior Publication Data

US 2013/0199472 A1 Aug. 8, 2013

(30) Foreign Application Priority Data

Oct. 19, 2010 (DE) ..... 10 2010 048 709

(51) Int. Cl.
*F01L 1/18* (2006.01)
*F01L 1/26* (2006.01)
*F01L 13/00* (2006.01)

(52) U.S. Cl.
CPC ..... *F01L 1/267* (2013.01); *F01L 13/0063* (2013.01); *F01L 13/0026* (2013.01)
USPC ..... 123/90.44; 123/90.16; 123/90.39; 74/569

(58) Field of Classification Search
USPC ..... 123/90.16, 90.39, 90.44; 74/569
See application file for complete search history.

(56) References Cited

U.S. PATENT DOCUMENTS

| | | | |
|---|---|---|---|
| 4,539,951 | A | 9/1985 | Hara et al. |
| 5,373,818 | A | 12/1994 | Unger |
| 2009/0194048 | A1 | 8/2009 | Schoen et al. |

FOREIGN PATENT DOCUMENTS

| | | | |
|---|---|---|---|
| DE | 19 45 046 | A | 7/1971 |
| DE | 100 61 618 | A1 | 6/2002 |
| DE | 101 40 635 | A1 | 4/2003 |
| DE | 103 23 665 | A1 | 12/2004 |
| DE | 10 2004 003 327 | A1 | 9/2005 |
| DE | 10 2005 010 484 | B3 | 10/2006 |
| EP | 0 638 706 | A1 | 2/1995 |
| EP | 1 760 278 | A2 | 3/2007 |
| JP | S 62 13709 | A | 1/1987 |

*Primary Examiner* — Ching Chang
(74) *Attorney, Agent, or Firm* — Norman B. Thot

(57) ABSTRACT

A mechanically controllable valve operating mechanism includes a cylinder head, a camshaft, a transmission arrangement mounted to move in the cylinder head via a bearing device. A gas exchange valve has the transmission arrangement act thereon. A valve-lift adjusting device comprises a rotatable adjusting element with an eccentric element having two base points and a peak contour, and at least one further eccentric element. The valve-lift adjusting device acts on the transmission arrangement so that different valve-lift positions are settable. The transmission arrangement is connected to the valve-lift adjusting device and to the camshaft. The at least one further eccentric element of the rotating adjusting element is arranged so that at least two peak contours are provided so that, depending on a rotational angle α of the rotating adjusting element, the eccentric element or the at least one further eccentric element engage with the transmission arrangement.

12 Claims, 3 Drawing Sheets

MECHANICALLY CONTROLLABLE VALVE OPERATING MECHANISM, AND MECHANICALLY CONTROLLABLE VALVE OPERATING MECHANISM ARRANGEMENT

CROSS REFERENCE TO PRIOR APPLICATIONS

This application is a U.S. National Phase application under 35 U.S.C. §371 of International Application No. PCT/EP2011/065044, filed on Aug. 31, 2011 and which claims benefit to German Patent Application No. 10 2010 048 709.0, filed on Oct. 19, 2010. The International Application was published in German on Apr. 26, 2012 as WO 2012/052216 A1 under PCT Article 21(2).

FIELD

The present invention relates to a mechanically controllable valve operating mechanism having a gas exchange valve on which a transmission arrangement acts by means of an end surface, wherein the transmission arrangement is mounted movably in the cylinder head by means of bearing means, and wherein the transmission arrangement is operatively connected to a valve-lift adjusting means and a camshaft, wherein the valve-lift adjusting means has a rotatable adjusting element with an eccentric element which has two base points and a peak contour and which acts on the transmission arrangement counter to a pre-stressing force of a spring element in such a way that different valve-lift positions can be set. The present invention further relates to a mechanically controllable valve operating mechanism arrangement having a plurality of gas exchange valves arranged in line to which at least two in-line cylinders are assigned and a transmission arrangement is assigned to one gas exchange valve, wherein each transmission arrangement is mounted movably in the cylinder head by means of bearing means, and wherein each transmission arrangement is operatively connected to a respective valve-lift adjusting means and a camshaft, wherein each valve-lift adjusting means has a rotatable adjusting element with an eccentric element which has two base points and a peak contour and which acts on the transmission arrangement counter to a pre-stressing force of a spring element in such a way that different valve-lift positions can be set, such as zero lift, partial lift and full lift, wherein a plurality of adjusting elements can be driven by one driving element.

BACKGROUND

EP 638 706 A1 describes a valve operating mechanism and a valve operating mechanism arrangement where the valve lift is controlled or regulated by an eccentric shaft rotatably supported in a cylinder head, which shaft acts on the transmission arrangement such that valve lifts between zero and maximum can be set in a simple manner. The combustion process can thereby be adjusted to the respective operating state of the internal combustion machine. DE 10 2004 003 327 A1 describes providing adjusting elements in a valve operating mechanism arrangement which can be adjusted independently with the purpose of deactivating individual cylinders for certain operating states. A valve operating mechanism is also described in EP 1 760 278 A2 which comprises an eccentric element showing different curves, in particular, for partial lift and full lift. The adjusting element here also allows for a zero lift curve.

The above-described valve operating mechanisms/valve operating mechanism arrangements all have the disadvantage that an adjustment of the valve lift by means of the eccentric element curve must be performed very precisely. The variability of the valve lift settings is also very limited in a state of partial deactivation of cylinders, which in turn leads to increased fuel consumption and thus to higher emission values.

SUMMARY

An aspect of the present invention is to provide a valve operating mechanism or a valve operating mechanism arrangement that avoids the above-described disadvantages.

In an embodiment, the present invention provides a mechanically controllable valve operating mechanism which includes a cylinder head, a bearing device, a spring element, a camshaft, a transmission arrangement comprising an end surface. The transmission arrangement is mounted so as to be movable in the cylinder head via the bearing device. A gas exchange valve is configured to have the transmission arrangement act thereon via the end surface of the transmission arrangement. A valve-lift adjusting device comprises a rotatable adjusting element with an eccentric element having two base points and a peak contour, and at least one further eccentric element arranged in a circumferential direction. The valve-lift adjusting device is configured to act on the transmission arrangement counter to a pre-stressing force of the spring element so that different valve-lift positions are settable. The transmission arrangement is operatively connected to the valve-lift adjusting device and to the camshaft. The at least one further eccentric element of the rotating adjusting element is arranged so that at least two peak contours are provided so that, depending on a rotational angle $\alpha$ of the rotating adjusting element, the eccentric element or the at least one further eccentric element engage with the transmission arrangement. In this way, it is possible, firstly, to switch between at least three valve lift states in a simple and quick manner, it being irrelevant in which direction the adjusting element is turned. A low-cost solution is further provided that allows for a reduction of fuel consumption and emission values of an internal combustion engine by increasing the variability of a gas exchange valve.

BRIEF DESCRIPTION OF THE DRAWINGS

The present invention is described in greater detail below on the basis of embodiments and of the drawings in which.

DETAILED DESCRIPTION

Figure 1:
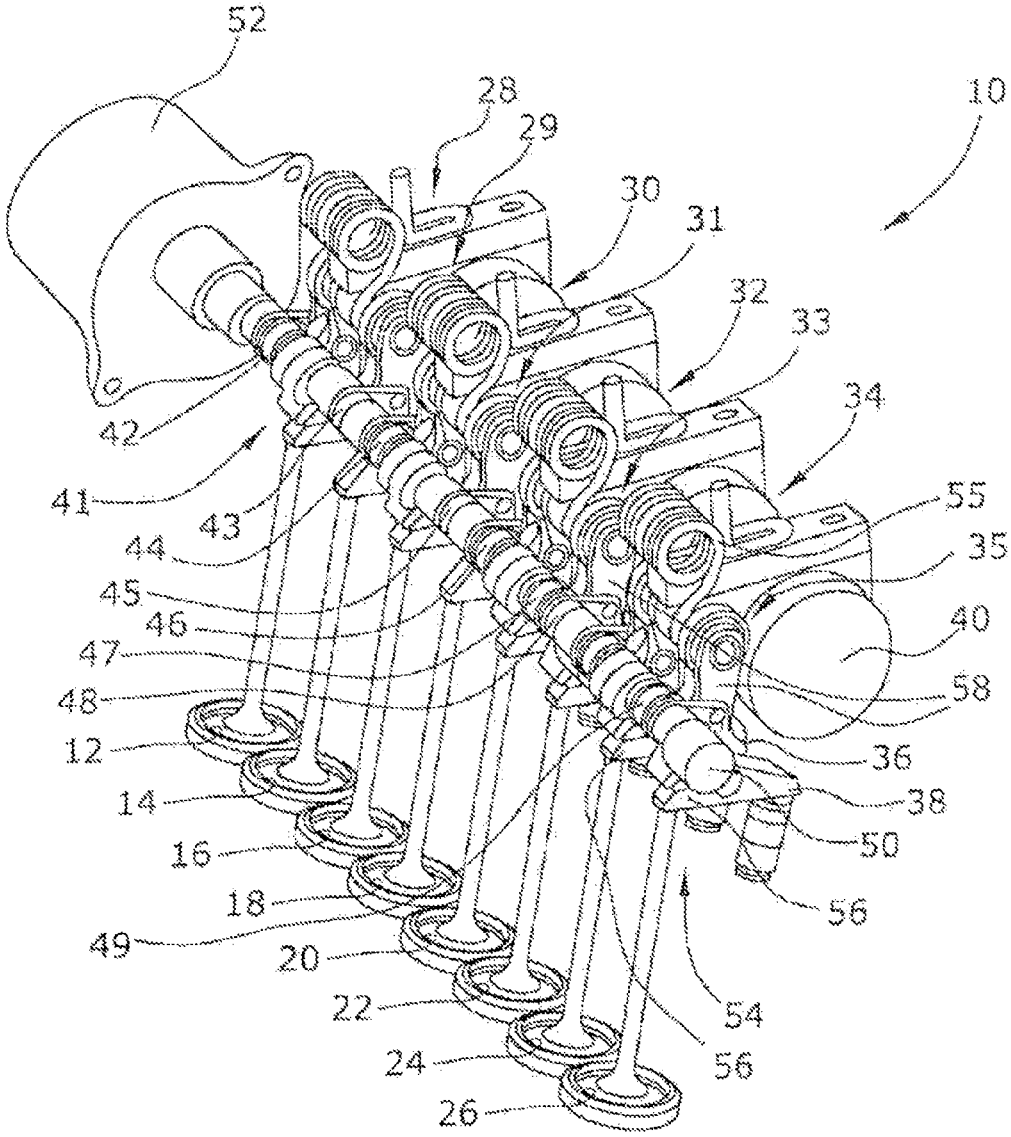
FIG. 1 shows a perspective illustration of a valve operating mechanism arrangement of the present invention.

In an embodiment of the present invention, the base points of the respective eccentric elements can, for example, be spaced from each other by at least a zero lift curve. A plurality of zero lift curve shapes are thus created on the circumference of the adjusting element, thereby allowing a much more variable purposeful deactivation of cylinders. It can moreover be advantageous if the eccentric elements have different shapes and thus have respective valve lift curve sets that are different in form. It is also possible that at least one eccentric element is formed asymmetrically with respect to the respective peak point. In an embodiment of the present invention, the transmission arrangement includes at least one pivot lever and at least one rocker lever, wherein the pivot lever engages the gas exchange valve with a work curve and the rocker lever is operatively connected with the valve lift adjusting means and the camshaft and engages the pivot lever with a work curve.

In an embodiment of the present invention, at least one adjusting element comprises at least one further eccentric element along its circumferential direction to provide at least two peak contours so that, depending on the rotation angle $\alpha$ of the adjusting element, different eccentric elements can pass into engagement with the transmission arrangement. Such an arrangement provides an economic and simple to manufacture possibility to deactivate individual valves, and thus cylinders, of an internal combustion machine in certain operating states. If the valve operating mechanism arrangement is configured such that the base points of the respective eccentric elements of the at least one adjusting element are spaced from each other by at least one zero lift curve, it is possible to realize the engine deactivation in a very variable manner. A large set of valve lift curves for the various load states is nevertheless still available to the cylinders operated. This variability is even increased if the eccentric elements have different shapes and/or at least one eccentric element is formed asymmetrically with respect to the respective peak point. In an embodiment of the present invention, a plurality of adjusting elements can be adapted to be driven by one driving element.

In an embodiment of the present invention, a plurality of eccentric elements can be provided on one eccentric shaft.

In an embodiment of the present invention, each transmission arrangement has at least one pivot lever and at least one rocker lever, where the pivot lever engages the gas exchanging valve by means of an end face and the rocker lever is operatively connected with the valve lift adjusting means and a camshaft and engages the pivot lever by means of a work curve. For an optimal combustion, it is advantageous if an even number of cylinders is provided, one half of the cylinders comprising gas exchange valves which each have one eccentric element more assigned thereto than the other half of the gas exchanging valves. On the outlet side, one half of the cylinders may further have gas exchanging valves that are operatively connected with a valve lift adjusting means, while the other half of the cylinders are adapted for conventional operation.

The present invention will be described hereinafter with respect to the drawings.

FIG. 1 illustrates an embodiment of a valve operating mechanism arrangement 10 of the present invention comprising a plurality of in-line gas exchange valves 12, 14, 16, 18, 20, 22, 24 and 26. In the present case, two inlet gas exchange valves are respectively assigned to one cylinder of the internal combustion machine. In the present instance, the mechanically controllable valve operating mechanism arrangement 10 comprises four transmission arrangements 28, 29, 30, 31, 32, 33 and 34, 35, each of which has assigned thereto two gas exchange valves 12, 14; 16, 18; 20, 22; 24, 26. The transmission arrangements 28, 29, 30, 31, 32, 33 and 34, 35 are supported in a manner known per se in the cylinder head using bearing means. In FIG. 1, the bearing means 36, 38 are illustrated merely as examples for the bearing of a pivot lever 56 of the transmission arrangement 35. The transmission arrangements 28, 29, 30, 31, 32, 33 and 34, 35 are further operatively connected with a camshaft 40 in a manner known per se. Each transmission arrangement 28, 29, 30, 31, 32, 33 and 34, 35 is controllable by means of adjusting elements 42, 43, 44, 45, 46, 47 and 48, 49 of a valve lift adjusting means 41 such that a smaller or a larger valve lift of the inlet valves 12, 14; 16, 18; 20, 22; 24, 26 can be set. In the present embodiment, the adjusting elements 42, 43, 44, 45, 46, 47 and 48, 49 are assigned to two inlet valves 12, 14; 16, 18; 20, 22; 24, 26, respectively, and are designed as eccentric elements 60, 62 provided on an eccentric shaft 50. In the present embodiment, the eccentric shaft 50 is adapted to be driven in a manner known per se by means of a driving element 52. It is also possible to assign a transmission arrangement to each of the plurality of gas exchange valves. The driving element 52 may be a rotary drive running both clockwise and counterclockwise. The eccentric shaft 50 can thereby be driven such that, depending on the given position, the valve lift corresponding to the next operating state can be selected in a quick and precise manner by implementing the corresponding eccentric elements 60, 62. Even rotation angles >360° can thereby be realized.

In the present embodiment, a mechanically controllable valve operating mechanism 54 comprises the transmission arrangement 35 and the gas exchange valve 26. In this case, the transmission arrangement 35 is formed by a pivot lever 56 and a rocker lever 58, the pivot lever 56 engaging the gas exchange valve 26 by means of an end face and the rocker lever 58 being operatively connected with the valve lift adjusting means 41 and the camshaft 40. The adjusting element 48 of the valve lift adjusting means 41 here engages an engagement element, not illustrated in detail (a roller, for instance), of the rocker lever 58 against a pre-stressing force of a spring 55. The rocker lever 58 engages the pivot lever 56 by means of a work curve not illustrated in detail. Guide rollers are arranged on the opposite side, which guide the rocker lever 58 in a slotted link. The guide rollers themselves are supported on a shaft that connects two adjacent rocker levers, with a roller being arranged on the shaft between the guide rollers, which is operatively connected with the camshaft. One cam of the camshaft is thus operatively connected with two transmission arrangements. With respect to the function and the operation of such a transmission arrangement, reference is made to DE 10 1140 635 A1.

Figure 2:
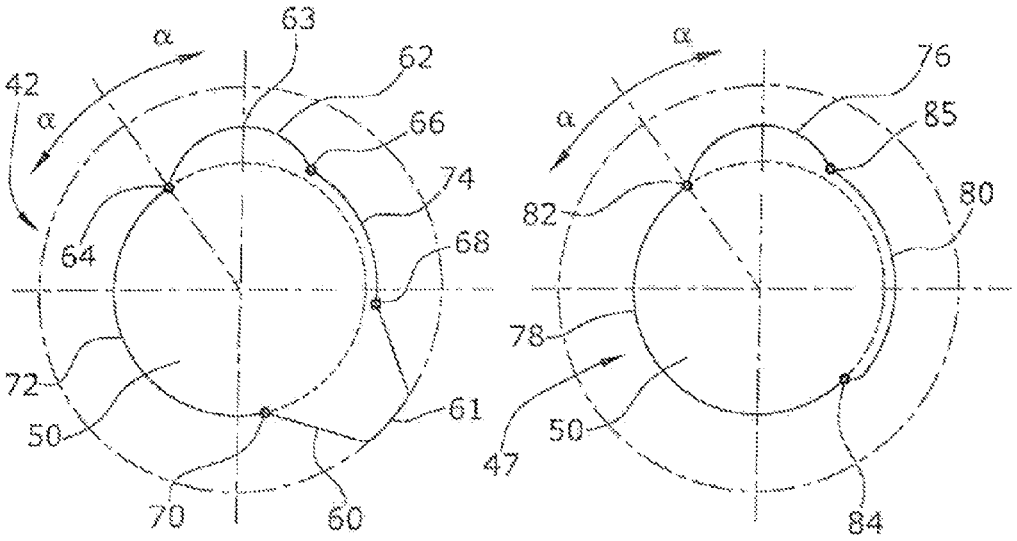
FIG. 2 shows a sectional view of an eccentric shaft with two adjusting elements.

The present invention provides that individual adjusting elements, in the present embodiment the adjusting elements 42, 43 and 48, 49, comprise a further eccentric element (see FIG. 2). FIG. 2 illustrates two sections through the eccentric shaft 50; one through the adjusting element 42 and the other through the adjusting element 47. In the present embodiment, the adjusting element 42 for the gas exchange valve 12 thus comprises two eccentric elements 60, 62 which can influence the lift height of the gas exchange valve 12. The eccentric elements 60, 62 each have a peak contour 61, 63, where the peak contour 63 is in the form of a single peak. In the present context, a peak contour is defined as a finite sequence of peaks, i.e., also a single one. The peak contour triggers the respective full lift height of the gas exchange valve which is operatively connected with the respective eccentric element of an adjusting element via the transmission arrangement. The eccentric elements 60, 62 are shaped differently with respect to their height and the curve shape, the eccentric element 62 being symmetric with respect to its peak point 63, while the eccentric element 60 is asymmetric, thereby leading to a flatter rise of the associated valve lift curve set. The associated peak point 63 or the peak contour 61 trigger the different full lift heights of the respective eccentric elements 60, 62.

In this embodiment, two base points 64 and 70 are further provided, where a base point is the point at which a zero lift curve passes into a partial lift curve. In the present embodiment, a zero lift curve 72 is thus formed between the respective base points 64 and 70. Idling points 66 and 68 are further provided, at which an idling lift curve passes into a partial lift curve. The region between the idling points 66 and 68 is accordingly referred to as the idling lift curve 74 which is raised on the eccentric shaft by about 0.2 mm with respect to the zero lift curve. The idling lift curve 74 has the advantage that during control by means of this region or when passing through this region, the cylinder is not completely deactivated and therefore does not cool down. The second adjusting element 47 has only one eccentric element 76 which is formed congruently in shape and height with the eccentric element 62. A zero lift curve 78 and an idling lift curve 80 are further provided that merge in the region of the peak contour 61 of the adjusting element 42 and which are defined by base points 82, 84 and an idling point 85.

It should be clear that all conceivable shapes that seem reasonable can be used for the eccentric elements. It is also possible that one adjusting element comprises more than two eccentric elements. In the present embodiment, the adjusting elements 44 and 46 for the valve lift adjustment of the gas exchange valves 16, 18, 20 and 22 comprise only one eccentric element 62 and thus correspond to the adjusting element known from the prior art.

Figure 3:
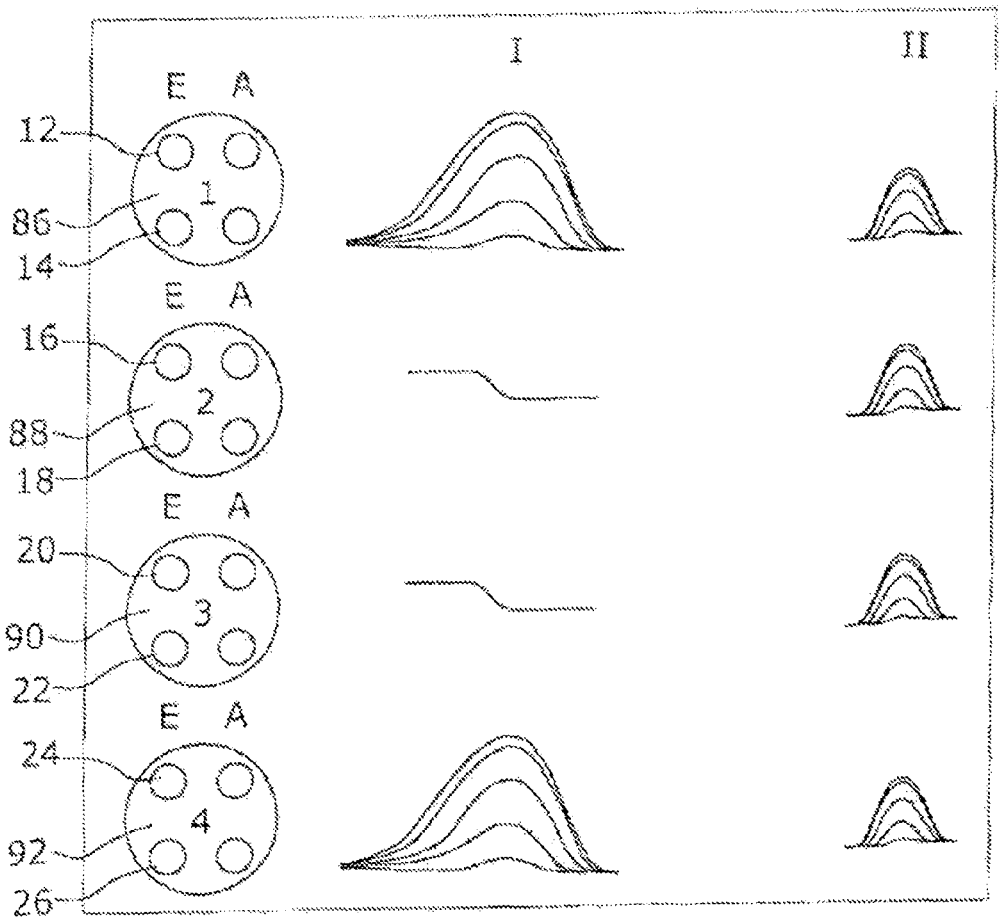
FIG. 3 shows a schematic illustration of the opening characteristic of the inlet valves with respect to the position of the adjusting elements.

FIG. 3 schematically illustrates the different valve lift settings according to the present embodiment. The illustration shows four cylinders 86, 88, 90, 92 that comprise the inlet valves 12, 14, 16, 18, 20, 22, 24 and 26 shown in from FIG. 1. The adjusting elements 42 and 48 associated to the gas exchange valves 12, 14, and 24, 26 here each have only one eccentric element 60. If the eccentric shaft 50 is adjusted such that the eccentric elements 62 engage the respective rocker levers 58, the valve lifts shown under I in FIG. 3 can be set for the inlet valves 12, 14 and 24, 26. The inlet valves 16, 18 and 20, 22 are deactivated. In order to make all inlet valves 12, 14, 16, 18, 20, 22, 24 and 26 open during the operation of the internal combustion machine, the eccentric shaft 50 is rotated such about an angle $\alpha$ that the eccentric elements 62 pass into engagement with the respective rocker levers 58. The valve lifts schematically illustrated under II can thus be realized for the inlet valves 12, 14, 16, 18, 20, 22, 24 and 26. The sense of rotation of the adjusting elements can thus be chosen such that the desired valve lift curve set can be controlled quickly and precisely.

For a simple deactivation of cylinders, however, it is particularly advantageous with an even number of cylinders to assign adjusting elements to one half of the cylinders, which elements each have one eccentric element more than the other half of the cylinders. Of course, it is also possible to control the outlet valve by means of such an arrangement, in order to provide a corresponding deactivation of the outlet valves when the inlet valves are deactivated.

The present invention is not limited to embodiments described herein; reference should be had to the appended claims.

What is claimed is:

1. A mechanically controllable valve operating mechanism comprising:

a cylinder head;

a bearing device;

a transmission arrangement comprising an end surface, the transmission arrangement being mounted so as to be movable in the cylinder head via the bearing device;

a gas exchange valve configured to have the transmission arrangement act thereon via the end surface of the transmission arrangement;

a spring element;

a valve-lift adjusting device comprising a rotatable adjusting element with an eccentric element having two base points and a peak contour, and at least one further eccentric element arranged in a circumferential direction, the valve-lift adjusting device being configured to act on the transmission arrangement counter to a pre-stressing force of the spring element so that different valve-lift positions are settable; and a camshaft;

wherein, the transmission arrangement is operatively connected to the valve-lift adjusting device and to the camshaft, and wherein, the at least one further eccentric element of the rotating adjusting element is arranged so that at least two peak contours are provided so that, depending on a rotational angle $\alpha$ of the rotating adjusting element, the eccentric element or the at least one further eccentric element engage with the transmission arrangement, and the two base points are separated from each other by at least one zero lift curve.

2. The mechanism as recited in claim 1, wherein the eccentric element and the at least one further eccentric element have different shapes.

3. The mechanism as recited in claim 1, wherein at least one of the eccentric element and the at least one further eccentric element is formed asymmetrically with respect to a peak point.

4. The mechanism as recited in claim 1, wherein the transmission arrangement further comprises at least one pivot lever comprising a pivot lever end face, and at least one rocker lever, wherein, the at least one pivot lever is configured to engage the gas exchange valve via the pivot lever end face, and the at least one rocker lever is configured to be operatively connected with the valve-lift adjusting device and the camshaft and to engage the pivot lever via a work curve.

5. A mechanically controllable valve operating mechanism arrangement comprising:

a cylinder head;

a bearing device;

gas exchange valves arranged in a line;

cylinders configured to be in-line, at least two of the gas exchange valves being assigned to each of the cylinders;

a transmission arrangement assigned to each of the gas exchange valves, each transmission arrangement being mounted so as to be movable in the cylinder head via the bearing device;

a spring element;

a valve-lift adjusting device comprising at least one rotatable adjusting element with at least one eccentric element having two base points and a peak contour, the valve-lift adjusting device being configured to act on the transmission arrangement counter to a pre-stressing force of the spring element so that different valve-lift positions are settable; and a camshaft;

wherein, each transmission arrangement is configured to be operatively connected to a respective valve-lift adjusting device and the camshaft, and wherein, at least one of the at least one rotatable adjusting element comprises at least one further eccentric element arranged along a circumferential direction so as to provide at least two peak contours so that, depending on a rotation angle $\alpha$ of the at least one adjusting rotatable element, the at least one eccentric element or the at least one further eccentric element engage with the transmission arrangement, and the two base points are separated from each other by at least one zero lift curve.

6. The arrangement as recited in claim 5, wherein the at least one eccentric element and the at least one further eccentric element have different shapes.

7. The arrangement as recited in claim 5, wherein at least one of the at least one eccentric element and the at least one further eccentric element is formed asymmetrically with respect to a peak point.

8. The arrangement as recited in claim 5, further comprising a driving element and a plurality of rotatable adjusting elements, wherein the plurality of rotatable adjusting elements can be driven by the driving element.

9. The arrangement as recited in claim 5, further comprising an eccentric shaft and a plurality of rotatable adjusting elements, wherein the plurality of rotatable adjusting elements is provided on the eccentric shaft.

10. The arrangement as recited in claim 5, wherein each transmission arrangement further comprises at least one pivot lever comprising a pivot lever end face, and at least one rocker lever, wherein, the at least one pivot lever is configured to engage a respective gas exchange valve via the pivot lever end face, and the at least one rocker lever is configured to be operatively connected with the valve-lift adjusting device and the camshaft and to engage the pivot lever via a work curve.

11. The arrangement as recited in claim 5, wherein an even number of the cylinders is provided, wherein a first half of the even number of cylinders comprises gas exchange valves with at least one eccentric element or at least one further eccentric element more assigned thereto than a second half of the even number of gas exchange valves.

12. The arrangement as recited in claim 5, further comprising an outlet side, wherein, a first half of the cylinders comprises gas exchange valves configured to be operatively connected with the valve-lift adjusting device, while a second half of the cylinders is configured to be operated in a conventional manner.

* * * * *